US011903544B2

(12) United States Patent
Digman

(10) Patent No.: US 11,903,544 B2
(45) Date of Patent: Feb. 20, 2024

(54) FILTRATION ASSEMBLY WITH GRINDING MECHANISM

(71) Applicant: Midea Group Co., Ltd., Foshan (CN)

(72) Inventor: Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 18/049,251

(22) Filed: Oct. 24, 2022

(65) Prior Publication Data

US 2023/0074773 A1 Mar. 9, 2023

Related U.S. Application Data

(63) Continuation of application No. 17/362,873, filed on Jun. 29, 2021, now Pat. No. 11,478,121.

(51) Int. Cl.
*A47L 15/42* (2006.01)

(52) U.S. Cl.
CPC ..... *A47L 15/4208* (2013.01); *A47L 15/4204* (2013.01); *A47L 15/4206* (2013.01); *A47L 15/4219* (2013.01); *A47L 15/4225* (2013.01); *A47L 15/4227* (2013.01)

(58) Field of Classification Search
None
See application file for complete search history.

(56) References Cited

U.S. PATENT DOCUMENTS

| | | | |
|---|---|---|---|
| 4,201,345 | A | 5/1980 | Ziegler |
| 5,184,635 | A | 2/1993 | Tromblee et al. |
| 5,433,232 | A | 7/1995 | Young, Jr. |
| 5,779,812 | A | 7/1998 | Thies et al. |
| 5,837,151 | A | 11/1998 | Jozwiak |
| 8,268,082 | B2 | 9/2012 | Elick et al. |
| 8,707,973 | B2 | 4/2014 | Yoon et al. |
| 8,808,462 | B2 | 8/2014 | Rieger et al. |
| 2006/0237035 | A1 | 10/2006 | Ferguson et al. |

FOREIGN PATENT DOCUMENTS

| | | | |
|---|---|---|---|
| EP | 1386575 | A1 | 2/2004 |

*Primary Examiner* — Levon J Shahinian
(74) *Attorney, Agent, or Firm* — Gray Ice Higdon

(57) ABSTRACT

A dishwashing appliance with a filtration assembly capable of removing/shredding/pulverizing large dishwashing debris from recirculated dishwashing fluid is provided. The dishwashing appliance may include a tub, a spray system, a recirculation pump, a drainage pump, and a grinding type filtration assembly in fluid communication with the spray system, the recirculation pump, and the drainage pump.

40 Claims, 9 Drawing Sheets

FILTRATION ASSEMBLY WITH GRINDING MECHANISM

BACKGROUND

Dishwashing appliances are used in many applications to clean articles such as dishes, silverware, cutlery, cups, glasses, pots, and pans, etc. During wash and rinse cycles, dishwashing appliances typically circulate dishwashing fluid through a dishwashing chamber over those articles to be cleaned or rinsed. The dishwashing fluid may be, e.g., various combinations of water and detergent during the wash cycle (which may include additives) during the rinse cycle. Conventional dishwashing appliances include a recirculation pump and a drainage pump for recirculating and draining the dishwashing fluid, respectively, within the dishwashing chamber. The recirculation pump feeds the dishwashing fluid to various spray arm assemblies for distribution throughout the dishwashing chamber. The dishwashing fluid is then collected in a sump located at or near the bottom of the dishwashing chamber and pumped back into the dishwashing chamber through, e.g., nozzles in one or more spray arm assemblies and other openings that direct the dishwashing fluid against the articles to be cleaned or rinsed.

Depending upon the level of dishwashing debris upon the washing articles, the dishwashing fluid used during the wash and rinse cycles will become contaminated with dishwashing debris in the form of particles that are carried with the dishwashing fluid. For many purposes, such as to protect the recirculation pump, it is beneficial to filter the contaminated dishwashing fluid by removing and/or reducing particles from the dishwashing fluid, so that relatively dean dishwashing fluid is supplied to the recirculation pump and applied to the articles in the dishwashing chamber.

Accordingly, a filtration assembly or system, which provides the functionality of retaining the dishwashing debris loosened by the dishwashing fluid and draining it away during a drainage cycle by the drainage pump, is a component for a dishwashing appliance. The filtration assembly in conventional dishwashing appliances typically passes a portion of the recirculated dishwashing fluid through the filters equipped in the system then into the recirculation pump. When the recirculation pump operates at a relatively high flow rate, however, keeping the filtration assembly clean and unblocked becomes increasingly difficult, especially when large amounts of dishwashing debris are suspended in the dishwashing fluid. Existing filtration assemblies are easily clogged, especially when the filter is located at the inlet of the recirculation pump and/or substantially horizontal. Also, some longer and larger particulates may escape to the drainage pipe, which may create problems such as clogged plumbing.

In order to handle large dishwashing debris, some filtration assemblies include a macerator to pulverize the large dishwashing debris into smaller pieces for easy disposal through the drain system. However, as most existing designs have the macerator blades driven by either the recirculation pump or the drainage pump, the existing systems are usually ineffective at breaking up large dishwashing debris. For some existing designs, the large dishwashing debris may even hardly reach the blades or lugs of the macerator. Some other known designs that may be more effective on these types of large dishwashing debris are often too costly for mass productions.

Therefore, there remains a need in the art to improve the existing filtration assemblies with grinding mechanisms.

SUMMARY

The present disclosure relates generally to a dishwashing filtration assembly with a grinding mechanism for large dishwashing debris, eliminating the need to scrape dishes before putting the dishes into the dishwash appliance. The grinding mechanism may be powered by a separate motor, and the filtration assembly is designed to be a 100% filtration assembly. In the disclosed filtration assembly, all dishwashing fluid will pass through at least two filters before recirculating back to the recirculation pump system, thereby improving dishwashing efficiency and performance.

The present disclosure is directed to an apparatus of a dishwashing appliance with a grinding mechanism. In some embodiments, a dishwashing appliance may include a tub defining a dishwashing chamber having a tub bottom therein, a spray system having one or more distribution devices within the dishwashing chamber, a recirculation pump operable to flow dishwashing fluid to the spray system, a drainage pump operable to flow dishwashing fluid mixed with dishwashing debris during dishwashing operation to a drainage pipe, and a filtration assembly in fluid communication with the spray system, the recirculation pump, and the drainage pump for filtration of the dishwashing fluid that has circulated through the dishwashing chamber. The filtration assembly may be positioned at bottom of the dishwashing chamber through an opening formed by the tub bottom thereof. The filtration assembly may further include a first filter with a first filtering permeability in a flat lid configuration having a first side and a second side, a second filter with a second filtering permeability, a sump housing through which the bottom open end of the second filter is disposed therein, and a grinding assembly. The first filter may be configured to receive all the dishwashing fluid and positioned at top of the filtration assembly and above the opening of the tub bottom to allow the dishwashing fluid to flow into the filtration assembly. The second filter may have a top open end and a bottom open end, and the top open end may be coupled to the second side of the first filter. The second filter may surround an inner surface of the sump housing to separate the sump housing into a grinding volume portion and a recirculation volume portion. The grinding assembly may be positioned at a bottom of the grinding volume portion of the sump housing, and include a rotatable grinding plate coupled to a shaft driven by a grinding motor and a stationary grinding ring having a plurality of notches.

In such embodiments, the sump housing may be in fluid communication with the drainage pump and the drainage pipe via a drainage pump port and a drainage pipe port. The recirculation chamber may be in fluid communication with the recirculation pump via a recirculation pump inlet port and a recirculation pump outlet port, and all the dishwashing fluid within the recirculation chamber are filtered by at least the first filter and the second filter. When the dishwashing fluid is extracted by the recirculation pump from the filtration assembly by filtering therethrough to the recirculation pump via the recirculation pump inlet port and into the spray system via the recirculation pump outlet port therefrom. The dishwashing fluid may circulate through the dishwashing chamber and flow back into the filtration assembly via the first filter, with the dishwashing debris proceeding into the grinding volume portion and being pulverized by the grinding assembly to a plurality of small pieces to pass through the plurality of notches to the drainage pump port.

In some embodiments, a filtration assembly for an appliance including a tub defining a washing chamber having a tub bottom may be positioned at bottom of the dishwashing chamber through an opening formed by the tub bottom thereof. The filtration assembly may include a first filter with a first filtering permeability in a flat lid configuration, a second filter with a second filtering permeability coupled to the first filter, a sump housing through which the second filter is disposed therein, and a grinding assembly. The second filter may be configured to receive all the dishwashing fluid and positioned at top of the filtration assembly and above the opening of the tub bottom to allow the dishwashing fluid to flow into the filtration assembly. The second filter may further surround an inner surface of the sump housing to separate the sump housing into a grinding volume portion and a recirculation volume portion. The grinding assembly may be positioned at a bottom of the grinding volume portion of the sump housing, and include a rotatable grinding plate coupled to a shaft driven by a grinding motor and a stationary grinding ring having a plurality of notches.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein. Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure

DETAILED DESCRIPTION

Figure 1:
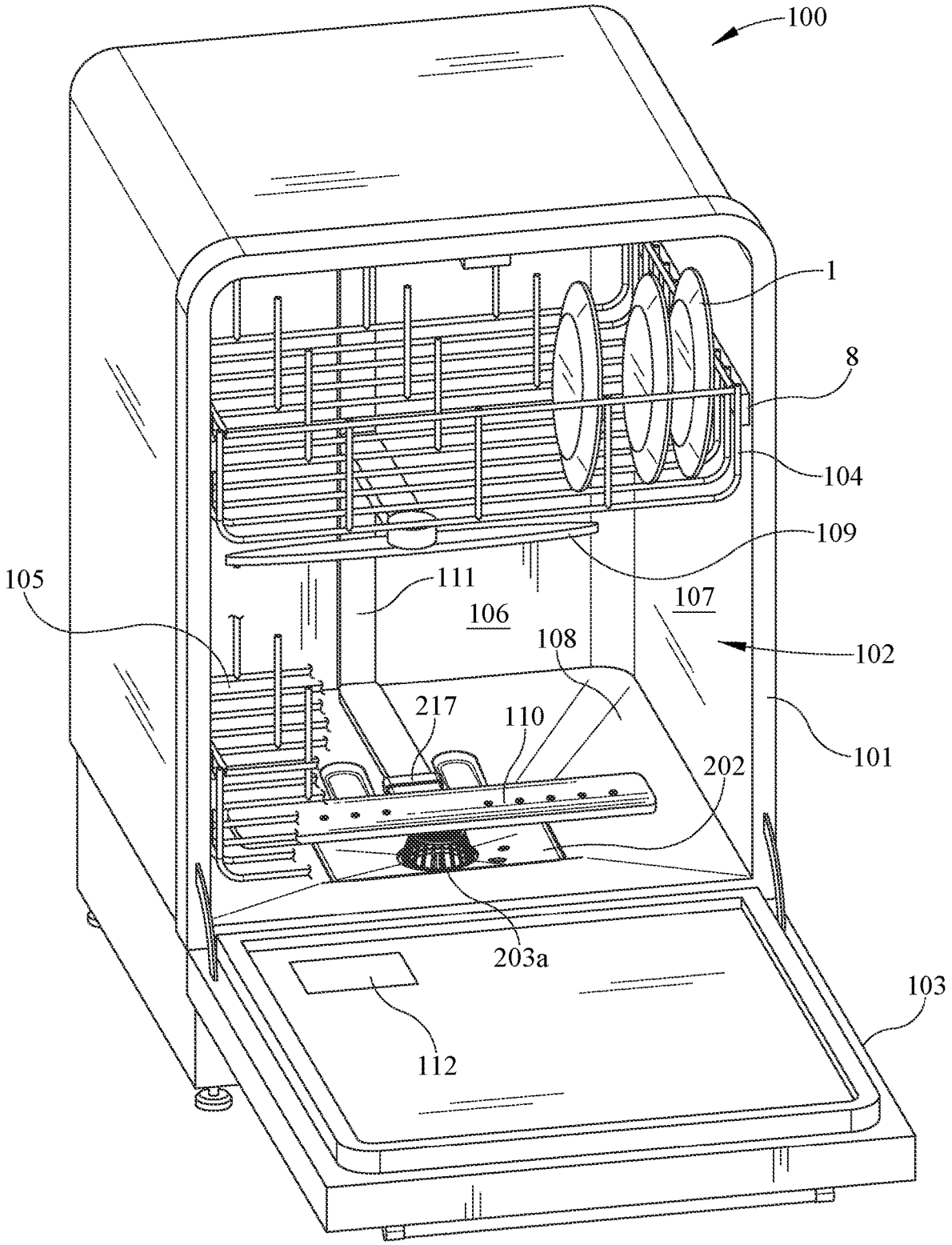
FIG. 1 is a perspective view of a dishwashing appliance with filtration assembly with a grinding mechanism, with a front door in a horizontal open position, according to an embodiment of the present disclosure.

It is to be understood that a dishwashing filtration assembly or system with a grinding mechanism is not limited in its application to the details of construction and the arrangement of components set forth in the following description or illustrated in the drawings. The described embodiments are capable of other configurations and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalents thereof, as well as additional items. Unless limited otherwise, the terms "connected," "coupled," and "mounted," and variations thereof herein, are used broadly and encompass direct and indirect connections, couplings, and mountings. In addition, the terms "connected" and "coupled" and variations thereof are not restricted to direct physical or mechanical connections or couplings.

The embodiments discussed hereinafter will, for convenience only, focus on the implementation of the hereinafter-described techniques within a residential type dishwashing appliance. However, it should be understood that the techniques may also be used in connection with other types of home appliances in some embodiments. For example, the techniques may be used in a commercial dishwashing application or a washing appliance (e.g., a washer) in some embodiments. Moreover, at least some of the herein-described techniques (e.g., a rotating self-cleaning device) may be used in connection with other different dishwashing appliance configurations, including dishwashing appliances utilizing filtration assemblies and/or dishwashing drawers.

Turning now to the drawings, wherein like numbers denote like parts throughout the several views, FIG. 1 is a perspective view of a dishwashing appliance 100 with a grinding type filtration assembly 200 according to an embodiment of the present disclosure. The dishwashing appliance 100 may share many features of a conventional dishwashing appliance and may not be described in detail herein except as necessary for a complete understanding of the disclosure. As shown in FIG. 1, the dishwashing appliance 100 may include a housing, cabinet, or tub 101, which the interior space thereof may be defined as a dishwashing chamber 102. The dishwashing chamber 102 may be, for example, a stamped metal cavity or an injection molded plastic cavity, with a top wall (not visible in the figures), a rear wall 106, an opposing side wall 107, and a tub bottom 108. The top wall, rear wall 106, opposing side wall 107, and the tub bottom 108 may be planar elements surrounding the dishwashing chamber 102. In some embodiments, the tub bottom 108 may be downwardly sloped to aid the dishwashing fluid sprayed from the spray system to be directed toward the filtration assembly 200 for filtration and recirculation, as will be described below. The dishwashing chamber 102 may have an open front face that may be accessible by opening a dishwashing door 103 hinged, typically, at its bottom for movement between a normally closed vertical position, wherein the dishwashing chamber 102 is sealed shut for dishwashing cycles, and a horizontal open position for loading and unloading of articles from the dishwashing appliance. The front door 103 may also include a detergent dispenser 112 located on the inner surface thereof for providing detergent to mix with the water for recirculation during wash cycles. Control over the dishwashing appliance 100 by a user may generally be managed through a control panel (not shown) typically disposed on a top or front portion of the front door 103, and it should be understood that in different designs, the control panel may include various types of input and/or output devices, including various knobs, buttons, lights, switches, textual and/or graphical displays, touch screens, etc. through which a user may configure one or more settings and start and stop a dishwashing operation.

In some embodiments, one or more dishwashing racks may be provided within the dishwashing chamber 102. For example, as shown in FIG. 1, an upper dishwashing rack 104 and a lower dishwashing rack 105 may be provided within the dishwashing chamber 102 to receive one or more washable items 1. The upper dishwashing rack 104 may be disposed above the lower dishwashing rack 105 and spaced apart by a predetermined distance. In some embodiments, the upper dishwashing rack 104 and the lower dishwashing rack 105 may be guided by a guide rail 8 provided on opposing side walls 107 of the dishwashing chamber 102, such that the dishwashing racks 104 and 105 may be drawn in and out through the open front face of the dishwashing chamber 102 between loading (extended) and dishwashing (retracted) positions along a substantially horizontal direction. In some embodiments, the lower dishwashing rack 105 may be supported on, for example, rollers, while the upper dishwashing rack 104 being supported by the guide rail 8. It should be understood that the dishwashing racks 104 and 105 may be in any feasible configurations suitable for holding dishes, pans, glasses, cups, utensils, or other washable items 1 that may be treated in the dishwashing chamber 102 without detracting from the disclosure. For example, in some embodiments as shown, the dishwashing racks 104 and 105 may include a plurality of tines to help support the washable items 1. It should be also understood that other particular support apparatus other than dishwashing racks 104 and 105 may be provided within the dishwashing chamber 102 for supporting the washable items 1 to be washed during dishwashing operation.

In some embodiments, the dishwashing appliance 100 may include a spray system for directing the dishwashing fluid into the dishwashing chamber 102 and over the washable items 1. The spray system may include one or more dishwashing fluid sprayers, which may be illustrated in the form of an upper spray arm assembly 109 and a lower spray arm assembly 110 as shown in FIG. 1. The one or more spray arm assemblies 109 and 110 may be provided within the dishwashing chamber 102 in a stacked manner and oriented relative to the dishwashing racks 104 and 105 such that the dishwashing fluid sprayed from the spray arm assemblies 109 and 110 may be directed onto the washable items 1 within the dishwashing racks 104 and 105. As shown in FIG. 1, for example, the upper spray arm assembly 109 may be located in an upper region of the dishwashing chamber 102 and in close proximity to the upper dishwashing rack 104, and the lower spray arm assembly 110 may be rotatably mounted at or near the bottom of the dishwashing chamber 102 and above the tub bottom 118 so as to rotate in relatively close proximity to the lower dishwashing rack 105. In some embodiments, another top spray arm (not shown in the figures) may be located above the upper dishwashing rack 104. However, this positioning is not intended to be limiting, as various distribution devices may be positioned through the dishwashing chamber 102. In such embodiments as shown in FIG. 1, the upper spray arm assembly 109 below the upper dishwashing rack 104 may provide a dishwashing fluid spray upwardly through the open bottom of the upper dishwashing rack 104, and the lower spray arm assembly 110 below the lower dishwashing rack 105 may respectively provide a dishwashing fluid spray upwardly onto the washable items 1 therein. It should be understood that the upper spray arm assembly 109 may also optionally provide a dishwashing fluid spray downwardly onto the washable items 1 within the lower dishwashing rack 105 thereunderneath. In some embodiments, while the upper spray arm assembly 109 may be, but need not be, a fixed spray arm, the lower spray arm assembly 110 may be, but need not be, a rotational spray arm. It should be understood that the arrangement and/or the configuration of the one or more spray arm assemblies 109 and 110 is not limited to the present disclosure as the description here merely serves for illustration. For example, the dishwashing appliance 100 may alternatively include various combinations of wall-mounted sprayers, rack-mounted sprayers, oscillating sprayers, fixed sprayers, rotating sprayers, and focused sprayers, etc.

Each of the spray arm assemblies 109 and 110 may include an arrangement of discharge ports or orifices for directing the dishwashing fluid onto the washable items 1 located within the dishwashing racks 104 and 105. In some embodiments, the arrangement of the discharge ports in the spray arm assemblies 109 and 110 may provide a rotational force by virtue of the dishwashing fluid flowing through the discharge ports. The resultant rotation of the spray arm assemblies 109 and 110 may then provide coverage of the washable items 1 with a spray of the dishwashing fluid. The dishwashing fluid for the spray arm assemblies 109 and 110 may be fed by a recirculation pump for circulating the dishwashing fluid within the dishwashing chamber 102, and the one or more spray arm assemblies 109 and 110 may be supplied by respective conduits. For example, in some embodiments, the dishwashing fluid for the upper spray arm assembly 109 may be fed through an upper spray arm supply conduit 111 extending upwardly along the rear wall 106. While not described in detail herein, the conduits may be hoses, pipes, tubes, or the like as would be understood in the art. In some embodiments, a heater (not shown) may heat the dishwashing fluid supplied to various temperatures, thereby improving dishwashing efficiency and performance.

Figure 2:
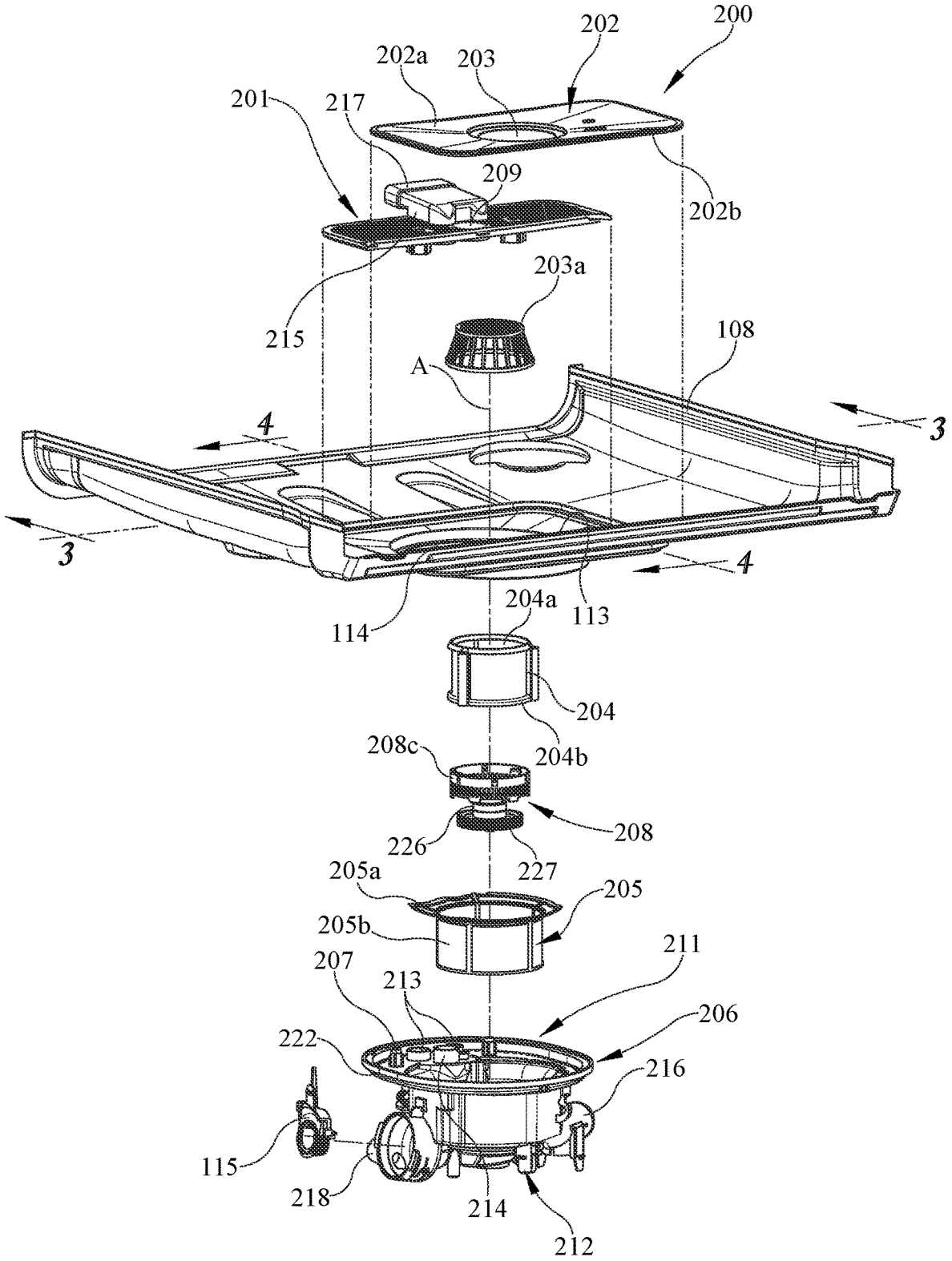
FIG. 2 is a perspective exploded view of the filtration assembly of FIG. 1, according to an embodiment of the present disclosure.
Figure 3:
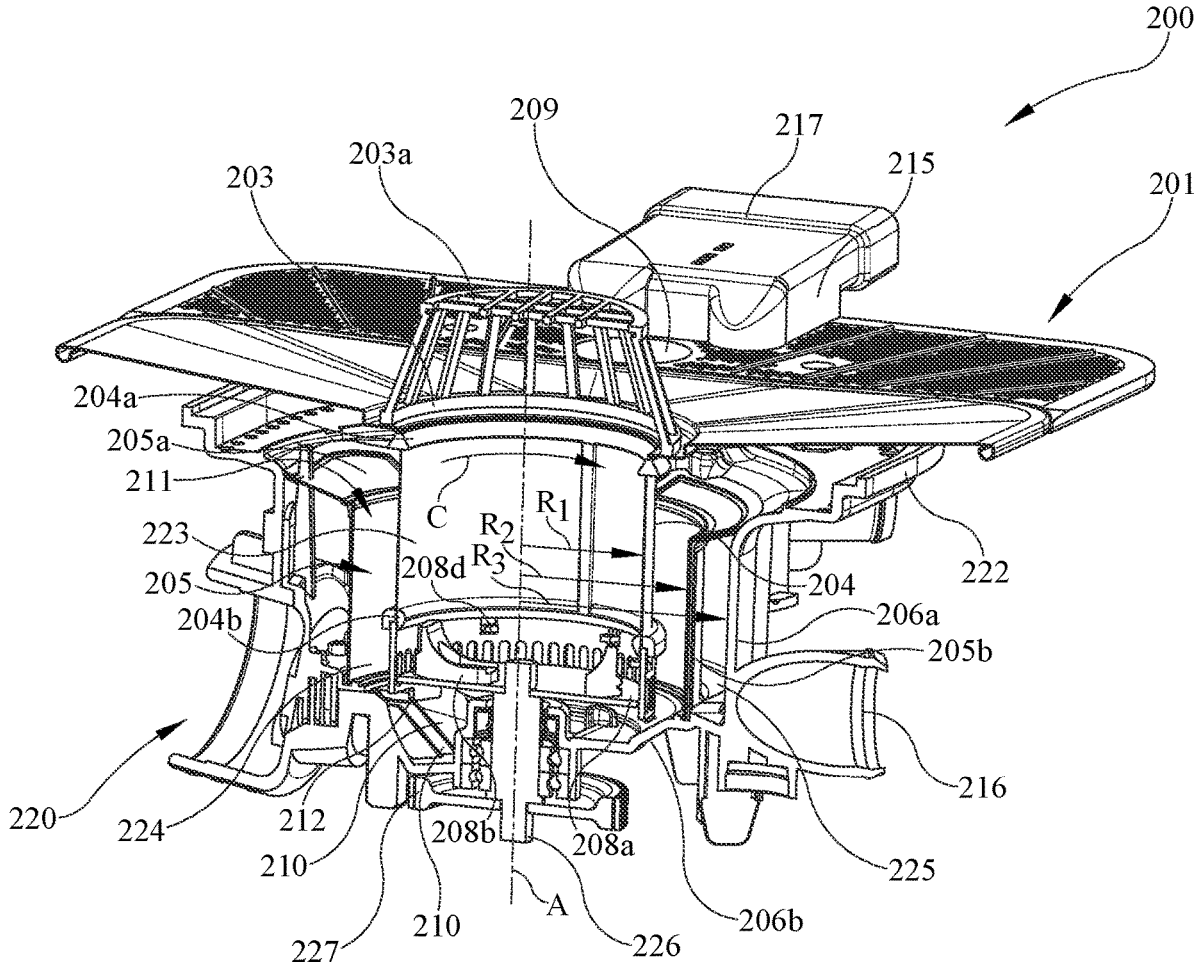
FIG. 3 is a side perspective sectional view of the filtration assembly of FIG. 2, according to an embodiment of the present disclosure.
Figure 4:
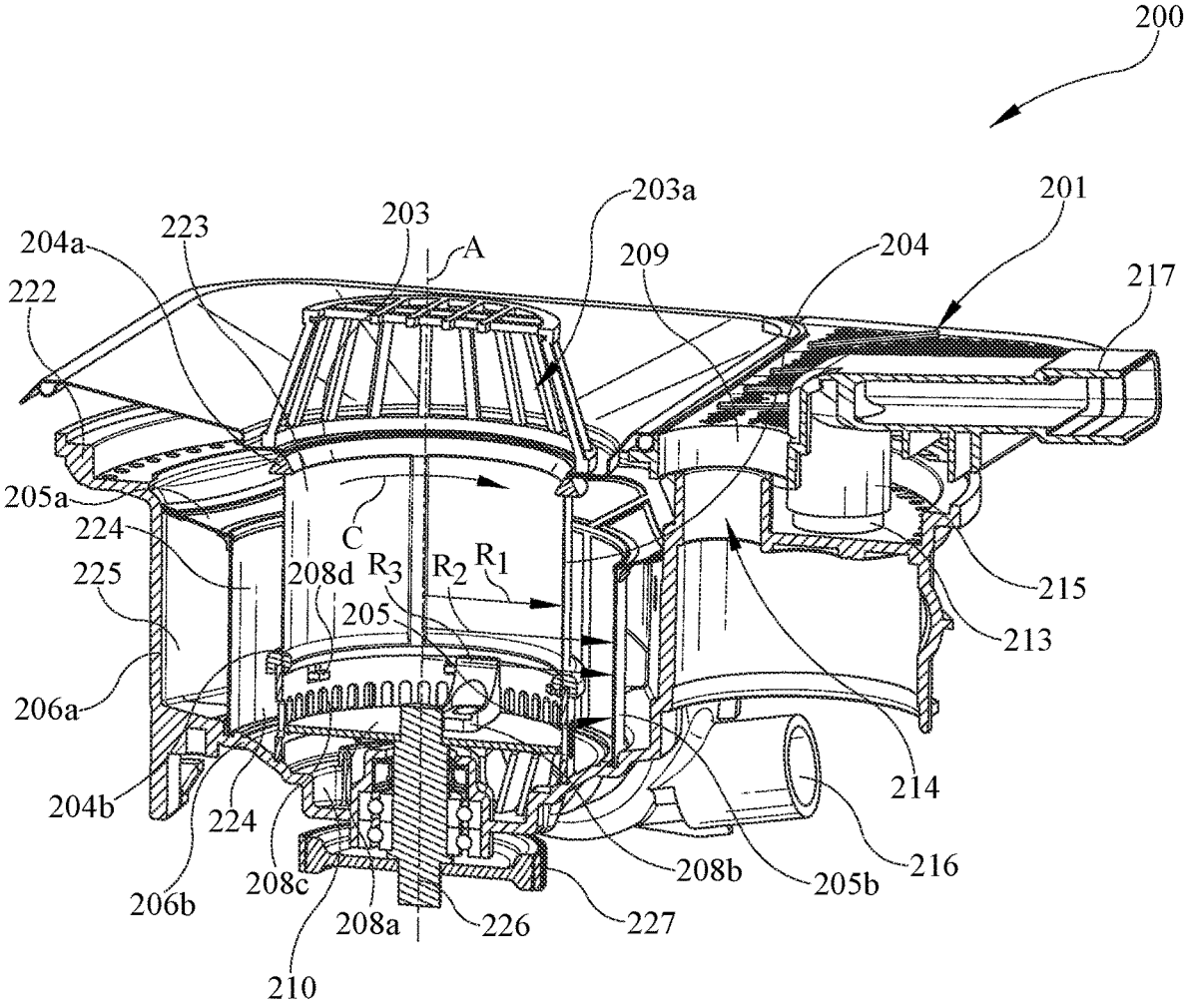
FIG. 4 is another side perspective sectional view of the filtration assembly of FIG. 2, according to an embodiment of the present disclosure.

In some embodiments as best shown in FIG. 2, the tub bottom 108 may include a recess 113 having an opening 114 over which a grinding type filtration assembly 200 may be removably received. The object of providing the filtration assembly 200 is to remove/shred/pulverize large dishwashing debris from the used dishwashing fluid before the dishwashing fluid is recirculated and once again is sprayed into the dishwashing chamber 102. The filtration assembly 200 may improve the final dishwashing result and ensure the function of the recirculation system (e.g., a recirculation pump) that otherwise could get clogged by the dishwashing debris contained in the dishwashing fluid. Referring to FIG. 2, an exploded view of the grinding type filtration assembly 200 in accordance with some embodiments of the present disclosure is illustrated. FIGS. 3 and 4 are cross-sectional views of the filtration assembly 200 taken along line 3-3 and line 4-4 of FIG. 2, respectively, and may be used to better illustrate the interior structure thereof. In some embodiments as shown, the filtration assembly 200 may include a first filter 202, a second filter 204, a sump housing 206, and a grinding assembly 208. The filtration assembly 200 may be configured to provide filtered dishwashing fluid for recirculation in the dishwashing chamber 102. In some embodiments, the first filter 202 may be positioned at the top of the filtration assembly 200 and take on a lid configuration, including a first, upper side 202*a* and a second, bottom side 202*b*, and can be generally rectangular in shape with a permeable surface body (e.g., a coarse filter screen) to allow the dishwashing fluid in the dishwashing chamber 102 to be initially filtered before entering the filtration assembly 200. In some embodiments, the first side 202*a* of the first filter 202 may be downwardly sloped towards the bottom of the dishwashing appliance 100 so that the dishwashing fluid sprayed from the spray system is collected in and directed toward the filtration assembly 200 for filtering and recirculation during dishwashing operation.

In some embodiments, the lid configured first filter 202 may be positioned right above the opening 114 of the recess 113 of the tub bottom 108 and include a large dishwashing debris inlet or opening 203 therethrough. In some embodiments, a larger dishwashing debris separator/soil trap 203*a* may be provided on the first side 202*a* to cover the opening 203 to allow larger dishwashing debris to enter the filtration assembly 200 while preventing other large items, such as a piece of silverware or another washable item 1 that is dropped from the rack assemblies 104 and 105, from entering or damaging the filtration assembly 200. With such an arrangement, the large dishwashing debris may flow into the filtration assembly 200 along with the dishwashing fluid through the opening 203 and flow down by gravity towards the grinding assembly 208 within the sump housing 206. In some embodiments, the large dishwashing debris opening 203 through the first filter 202 may also work for venting of the filtration chamber of the sump housing 206 during dishwashing operation. Without the one or more air vent or outlet, an air bubble could form underneath the first filter 202 and prevent the filtration assembly 200 from operating correctly. Further, in some embodiments, the first filter 202 may be removed from filtration assembly 200, e.g., to permit cleaning or washing of filters therein.

In some embodiments, there may also be a spray arm assembly plate 201 adjacent the first filter 202 and located above the recess 113 of the tub bottom 108. The spray arm assembly plate 201 may include one or more dishwashing fluid flow pathways for directing filtered dishwashing fluid back to the spray system. Different from the first filter 202, in some embodiments, the spray arm assembly plate 201 may be configured to prevent the dishwashing fluid from flowing therethrough. In such embodiments, different materials and/or material combinations, such as plastic or rubber coating on one or both of the first and second sides of the spray arm assembly 201, may be used to achieve a durable sealing effect.

Figure 7A:
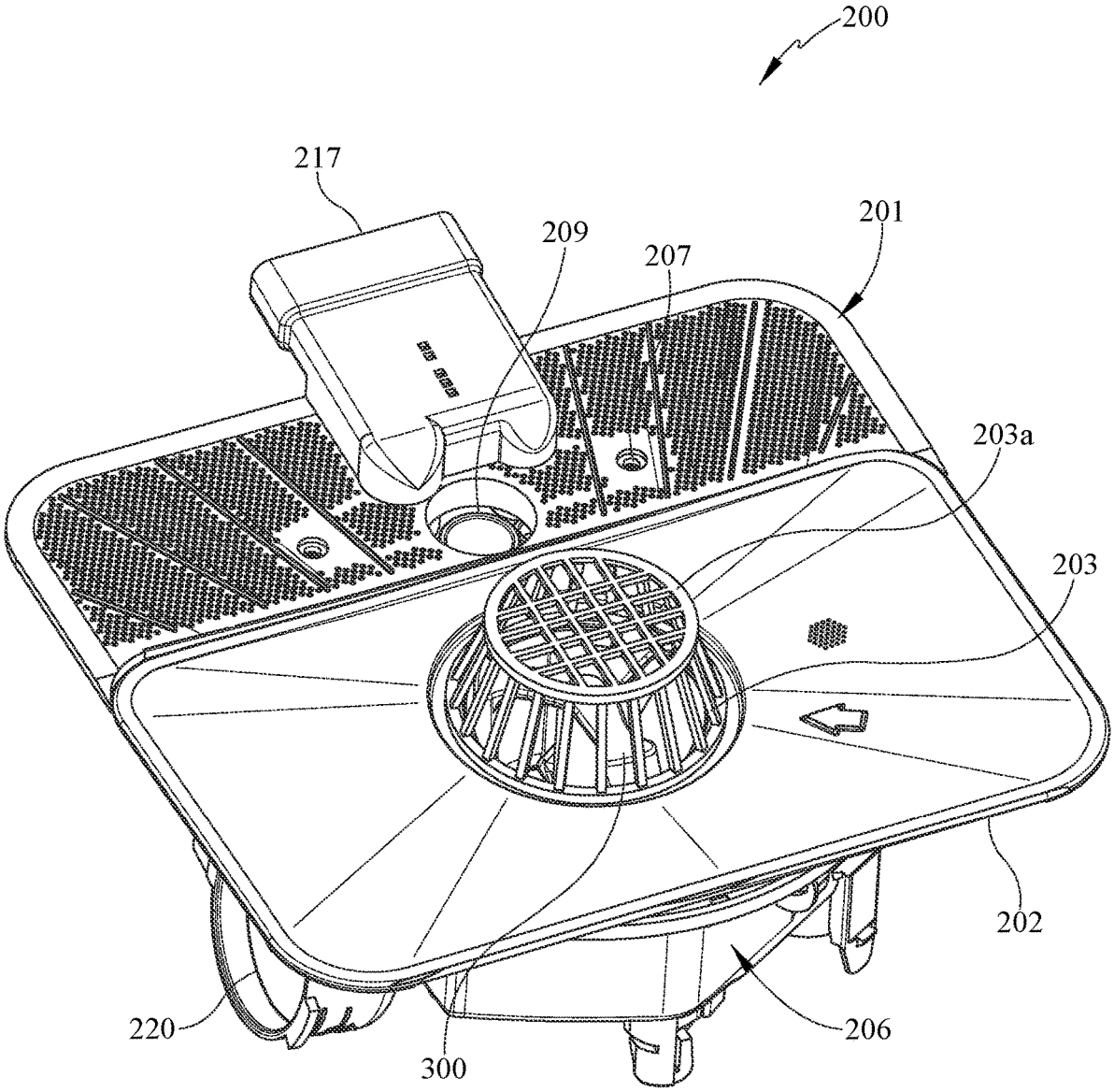
FIG. 7A is an upper perspective view of a filtration assembly with a built-in rotating self-cleaning device, according to an embodiment of the present disclosure.
Figure 7B:
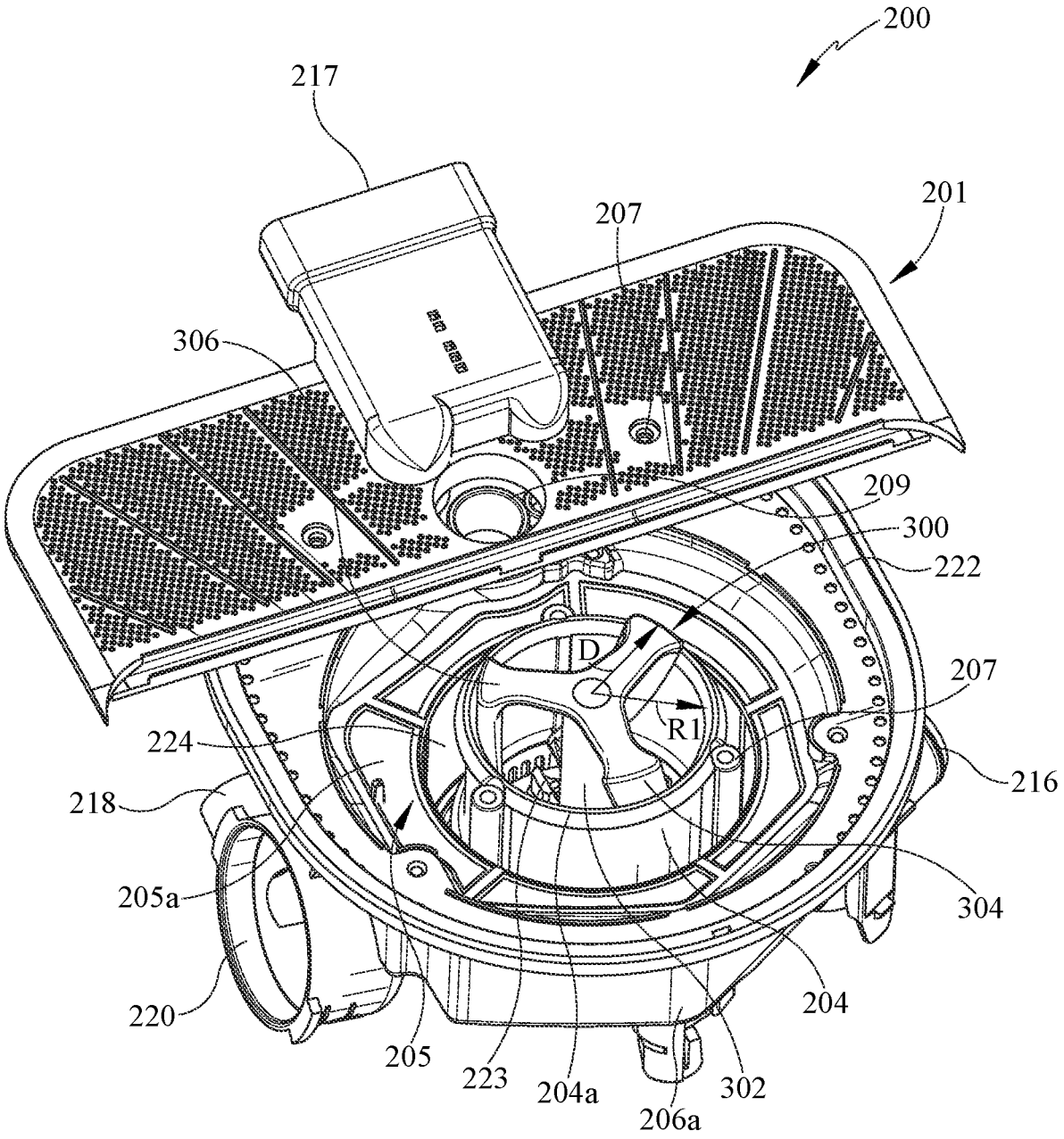
FIG. 7B is an upper perspective sectional view of the filtration assembly of FIG. 7A, according to an embodiment of the present disclosure.

In some embodiments, the filtration assembly 200 may include the sump housing 206 located underneath the first filter 202 for collecting the initially filtered dishwashing fluid from the dishwashing chamber 102 and the dishwashing debris. The sump housing 206 may include an open top portion 211 and a base portion 212. The open top portion 211 may be configured for receiving one or more filters and the grinding assembly 208 therethrough and may also define an inlet that permits the dishwashing fluid to flow into the filtration assembly 200. The base portion 212 may include one or more debris collection chambers and flow pathways in fluid communication with the recirculation pump and the drainage pump. In some embodiments, the top portion 211 of the sump housing 206 may include a flange portion 222 for accommodating various components, such as fastening elements 207 and/or one or more dishwashing fluid flow pathways. For example, in some embodiments, the flange portion 222 of the sump housing 206 may be coupled to the spray arm assembly plate 201 as shown in FIGS. 2 and 7B through one or more fasteners 207 (e.g., rivets, pins, screws, bolts, nuts, clips, flanges, or other hardware items). In some embodiments as shown, the one or more fasteners 207 may be pin-slot mechanisms for integrally coupling the different components (e.g., the first filter 202, the second filter 204, and the sump housing 206, etc.) together. It should be understood that other suitable coupling methods (e.g., hook-and-loop fasteners, snaps, riveting, adhesive, or the like) may also be acceptable here. In such a manner, the filtration assembly 200 may be easily assembled and disassembled for components change/replacement/clean in both a quick and easy manner. In some embodiments, one or more sealing members (e.g., elastomer O-rings) may be positioned to fit against different components of filtration assembly 200 wherein the different components are integrally disposed adjacent to one another, to further seal off the dishwashing fluid flow.

In some embodiments, the spray arm assembly plate 201 may include an opening 209 in fluid communication with a second flow path 214 built in the sump housing flange 222 of the sump housing 206 as shown in FIG. 4 to channel the recirculated dishwashing fluid from the filtration assembly 200 to the lower spray arm assembly 110. The coupling mechanism therebetween may be configured to prevent the dishwashing fluid from entering the filtration assembly 200 through the opening 209. In some embodiments, the spray arm assembly plate 201 may also include one or more flow paths in fluid communication with the spray system. For example, as shown in FIGS. 2 and 4, the spray arm assembly plate 201 may include an assembly plate flow path inlet 215 and an upper spray arm supply path inlet 217 coupled to the upper spray arm 109 through the upper spray arm supply path 111. In some embodiments as shown in FIG. 4, the assembly plate flow path inlet 215 may be coupled to a first sump housing flow path 213 built in the sump housing flange 222 to channel the recirculated dishwashing fluid from the filtration assembly 200 to the upper spray arm assembly 109.

As shown in FIG. 3, the filtration assembly 200 may define a first, vertical axial direction A, a second, radial directions R, and a third, circumferential direction C. In some embodiments, the sump housing 206 may include a side wall 206*a* and a bottom wall 206*b* that extends away from the open top portion 211, e.g., along the axial direction A. The side wall 206*a* may be substantially annular and extend along the circumferential direction C and between the top portion 211 and the bottom wall 206*b*, e.g., in order to assist in defining the filtration chamber therein. In such embodiments, the interior shape of the sump housing 206 may be generally circular, however, as should be understood, the shape and depth of the sump housing 206 are not limited thereto. Rather, the sump housing 206 may have various shapes and depths so long as the sump accommodates and effectively collects the required volume portion of dishwashing fluid used during operation.

In some embodiments, at least one second filter 204 may be in an approximate cylinder or cone-shaped configuration and positioned within the sump housing 206 around the vertical axis A. For example, a top end 204*a* of the second filter 204 may be coupled to the second or bottom side 202*b* and/or the soil trap 203*a* of the through opening 203 of the first filter 202, and a bottom end 204*b* of the second filter 204 may be coupled to the grinding assembly 208. In some embodiments, the planes of the top end 204*a* and the bottom end 204*b* may be parallel to each other. In such embodiments, the second filter 204 may divide the sump housing filtration chamber into a grinding volume portion 223 and a recirculation volume portion 224. Thus, the second filter 204 includes features for blocking or hindering particles or objects from passing between grinding volume portion 223 and the recirculation volume portion 224. In the exemplary embodiment shown in FIGS. 3 and 4, the recirculation volume portion 224 may be configured as an annulus surrounding the grinding volume portion 223 and is separated therefrom by the second filter 204. Accordingly, the grinding volume portion 223 may have a radial distance of R1, which is the radial distance from the second filter 204 to the vertical axis A, and the recirculation volume portion 224 may have a radial distance of R3-R1, which is the radial distance from the second filter 204 to the sump housing side wall 206*a*.

As mentioned previously, a grinding assembly 208, such as a macerator, may be provided within the sump housing 206 (e.g., at a bottom pf the grinding volume portion 223) to remove/shred/pulverize large dishwashing debris into particles small enough to safely pass through drainage plumbing. Once the particles are small enough to pass out of the grinding mechanism, they are flushed out into the drainage. For example, FIGS. 2-6 illustrate a typical grinding assembly 208 according to some embodiments. The illustrated grinding assembly 208 may include a rotating grinding plate 208*a* and a stationary grinding ring 208*c* including a plurality of notches defining spaced windows. The grinding plate 208*a* may be mounted to a motor shaft 226, and a motor (e.g., a separate motor 228 as shown in FIG. 6) may impart the rotational movement of the rotating grinding plate 208*a* through the shaft 226 to force the dishwashing debris against the grinding ring 208*c* to break the large dishwashing debris down into small pieces. In some embodiments, in order to adequately handle leafy or fibrous dishwashing debris, the grinding plate 208*a* may include a plurality of swivel lugs 208*b* that extend upwards. In some further embodiments, a plurality of breaker members 208*d* may also be provided on the grinding ring 208*c*, extending towards the center of the grinding ring 208*c* to break up large food debris further inside the grinding assembly 208. In some embodiments as shown in FIGS. 3-4, the bottom end 204*b* of the cone shaped second filter 204 around the vertical axis A may include an annular slot configured to be coupled to the upper edge of the grinding ring 208*c*.

In some embodiments, a third filter 205 surrounding the second filter 204 may also be provided to space apart from the side wall 206*a* to define a filtered volume portion 225 therebetween. In such embodiments, the third filter 205 may be positioned within the sump housing 206 to further create a filtered recirculation volume portion 225. Accordingly, as shown in FIGS. 3 and 4, the filtered recirculation volume portion 225 may have a radial distance of R3-R2, which is the radial distance from the third filter 205 to the sump housing side wall 206*a*. In some embodiments, the third filter 205 may be annular in an approximate cylinder or cone-shaped configuration and extend along the circumferential direction C, which is similar to the second filter 204. As shown in FIGS. 2-4, the third filter 205 may extend between about the top portion 211 and the base portion 212 and surround the second filter 204 along the circumferential direction C. In such embodiments, the third filter 205 may include a filter flange portion 205*a* and an approximate cone-shape base portion 205*b* around the vertical axis A, and the filter flange portion 205*a* may be in a truncated inverted umbrella configuration and coupled to the approximate cone-shaped base portion 205*b* below the first filter 202. With such an arrangement, the third filter 205 may better correspond to the sloped inner surfaces of the sump housing 206 to define the filtered recirculation volume portion 225. However, as will be understood by those skilled in the art, the filtration assembly 200 may include additional filters, thus, the filtered volume portion 225 may be filtered relative to one or more additional filters, which are not the filter 205. It should be appreciated that the shape and/or configuration of the second filter 204 and the third filter 205 is not limited thereto. The filters 204 and 205 could however also have other shapes like for example oval, rectangular, or triangular.

Figure 5:
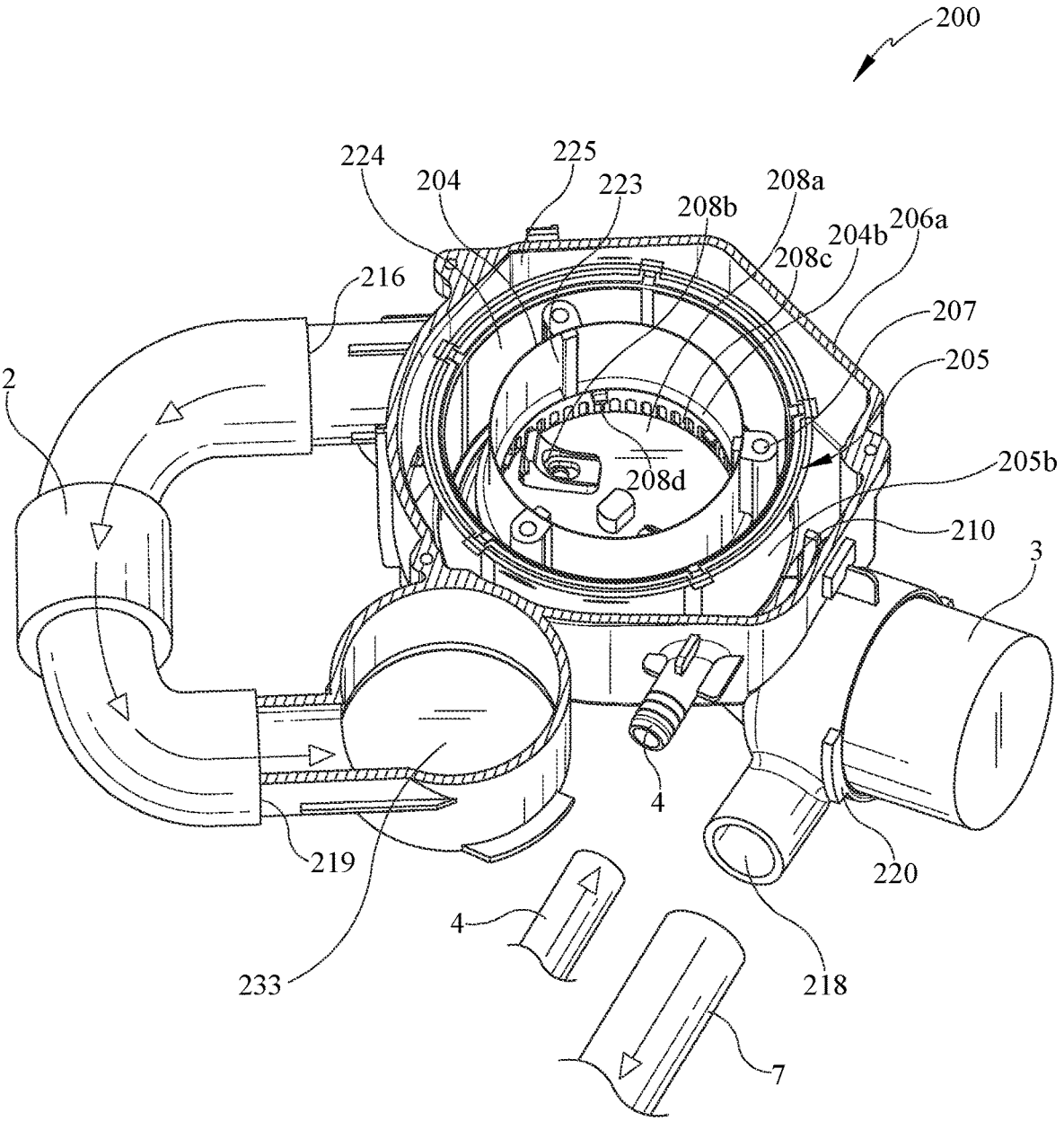
FIG. 5 is an upper perspective sectional view of the filtration assembly of FIG. 2, according to an embodiment of the present disclosure.
Figure 6:
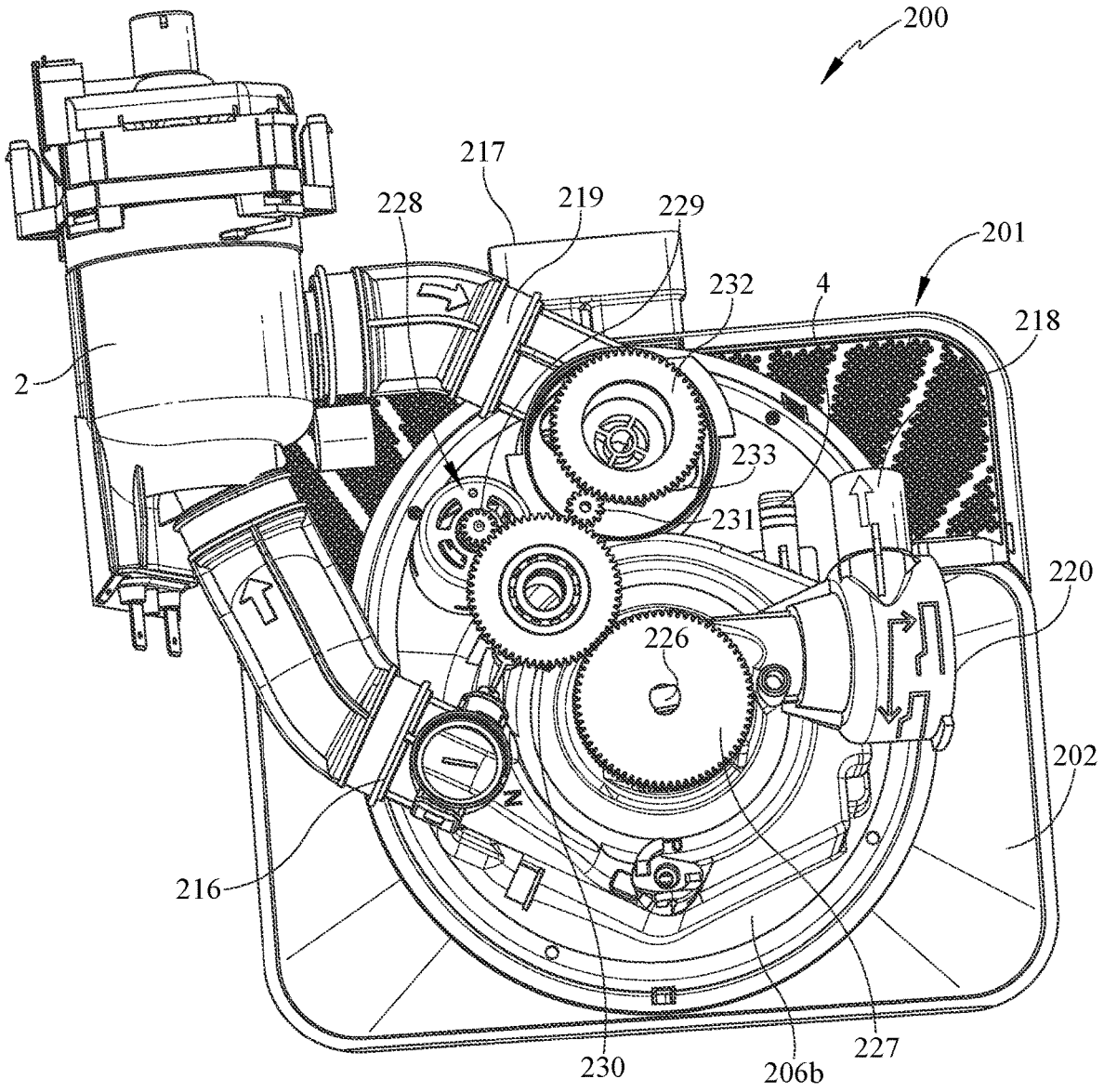
FIG. 6 is a bottom view of the filtration assembly of FIG. 2, according to an embodiment of the present disclosure.

A recirculation pump 2 as shown in FIG. 5 may be situated level with, or below the base portion 212 of the sump housing 206, and a recirculation pump inlet 216 with atmospheric pressure may be positioned at a side of the base portion 212 of the sump housing 206 to supply filtered dishwashing fluid to the recirculation pump 2. An opening may be arranged at the base portion 212 to be a recirculation intake port 216, and the dishwashing fluid collected in the filtration assembly 200 may flow to the recirculation pump 2 through the recirculation intake port 216 and the recirculation pump inlet 216 due to the suction force generated by the recirculation pump 2. In some embodiments, a recirculation pump outlet port 219, which is pressurized, may be configured to discharge the filtered, recirculated dishwashing fluid from the recirculation pump 2 to the spray arm system including one or more distribution devices, such as the spray arm assemblies 109 and 110.

Additionally, a drainage pump 3 as shown in FIG. 5 may be provided at a drainage pump port 220 and in fluid communication with a debris collection chamber 210 located at the base portion 212 of the sump housing 206 of the filtration assembly 200 and a drainage port 218. The debris collection chamber 210 provides a volume portion for receiving and temporarily holding solid dishwashing debris filtered apart from the recirculated dishwashing fluid during the wash cycle. In some embodiments, the debris collection chamber 210 may be an angled trough adjacent the drainage pump port 220 as shown in FIG. 3. In some embodiments, a drain pump cover 115 may be provided for covering and protecting the drainage pump 3.

As best shown in FIG. 5, the drainage pump 3 may be configured to pump dishwashing debris accumulated in the debris collection chamber 210 to the drainage port 218 and ultimately to a building plumbing system drainage pipe 7, with a negative pressure created at the drainage port 218 when the drainage pump is energized. In some embodiments, the drainage pump 3 may be positioned at the drainage pump port 220 and between the debris collection chamber 210 and the drainage port 218 to generate a suction force to force the dishwashing fluid and the dishwashing debris to the drainage port 218. A pump motor may be electrically connected to a motor controller (not shown) that controls the drainage pump and the recirculation pump respectively to achieve desired dishwashing cycle sequences during operation of the dishwashing appliance 100. In some embodiments, an auxiliary water pipe 4 may be provided to supply water to the sump housing 206 for better performance.

For mechanical filtration, the removal of soil particles of different sizes is typically achieved by providing fluid paths (such as pores or apertures) through a filter screen or filter media that are smaller than the particles for which filtration is desired. In some embodiments, the filtering permeability may be defined by a plurality of openings with a certain maximum allowable size (i.e., a certain filtering permeability) provided on a filter screen to allow the dishwashing fluid to pass through into the recirculation pump 2, while preventing the dishwashing debris greater than the maximum allowable size of the openings from passing through. Thus, the filter screen may prevent such sizes of dishwashing debris from flowing into, e.g., the recirculation pump 2 and the spray system. In such embodiments, the maximum allowable size or the filtering permeability may correspond to a maximum size of dishwashing debris the recirculation pump and the spray system can accommodate. Particles having a dimension larger than the size of the fluid paths will be trapped to be prevented from passing through the filter screen while particles smaller than the size of the fluid path will generally be able to pass through. For example, in some embodiments, a coarse filter may be employed on the first filter 202 and the second filter 204 to retain large soil particles, while the additional third filter 205 that is a fine filter may be utilized to remove even smaller particles. Some particle sizes and/or types may not be harmful to the pump or spray arm assemblies and, therefore, may be allowed to pass into the recirculation pump system.

In some embodiments, the first filter 202 may be provided with a first filtering permeability that filters relatively large dishwashing debris from the dishwashing fluid (e.g., a coarse filter screen), while the second filter 204 may be provided with a second filtering permeability smaller than the first filtering permeability that filters relatively fine dishwashing debris from the dishwashing fluid (e.g., a fine filter screen). In some embodiments, the third filter 205 may be provided with a third filtering permeability smaller than the second filtering permeability (e.g., a micron filter screen). In other words, in such embodiments, the first filtering permeability may be greater than the second filtering permeability, and the second filtering permeability may be greater than the third filtering permeability. Still in other words, for the embodiment depicted, the second filter 204 may be configured to filter dishwashing debris smaller than the plurality of openings in the first filter screen 202 but larger than the plurality of openings in the third filter screen 205. Accordingly, the filter screens 202, 204, and 205 may be configured to filter out dishwashing debris that has been washed from the debris-laden washable items 1 and that is larger than the individual openings in the filter screens 202, 204, and 205. The smaller the openings in the filter screen, the larger the volume portion of dishwashing debris that will be filtered from the contaminated dishwashing fluid, and vice versa. It should be appreciated, however, that in other exemplary embodiments, the plurality of filters may instead include any other suitable filter mediums as well as any other suitable support structure. The dishwashing debris in the form of sediment, soil, and/or particles may then be filtered and separated from the dishwashing fluid as it passes through the one or more filter screens.

In some embodiments, the filters 202, 204, and 205 may include a mesh wire or plastic screen for removing such particles or objects as will be understood by those skilled in the art. The filters 202, 204, and 205 may also be designed to have a considerably large screen area size to ensure the desired filtration capacity even though parts thereof are blocked by collected sediment particles and dirt. For example, in some embodiments, the second and third filters 204 and 205 may be configured to include an accordion-like cross section for increasing the presented filtration area. In some embodiments, the filters 202, 204, and 205 may have a substantially constant thickness, but the filters 202, 204, and 205 may be modified in a number of different ways without departing from the scope of the disclosure. In some embodiments, the entire first filter 202 in a lid configuration may be made of a filtering material similar to the filters 204 and 205 in order to maximize the filtering area, alternatively, in some embodiments, only a portion of the first filter 202 is made of a filtering material.

In some embodiments, the separate motor 228 used to rotate the grinding plate 208*a* may also be used for secondary purposes such as rotating a diverter plate or a spray feature of the spray system. For example, as shown in FIG. 6, there may be a drive/transmission system including multiple gears for rotating a diverter plate 233 by the grinding motor 228. In some embodiments, a first idler gear 230 may be located between a grinding motor gear 229 and a grinding shaft gear 227, and a second idler gear 231 may be located between the first idler gear 230 and a diverter plate gear 232. It is noted that in some embodiments, a separate motor may be used to rotate the first and/or the second idler gears 230 and 231. For example, the second idler gear 231 may be mounted to a slide or pivot, and the movement of the second idler gear 231 may be initiated by an independent solenoid or a wax motor (not shown) so that the second idler gear 231 may be engaged or disengaged between the first idler gear 230 and the diverter plate gear 232. In such embodiments, the diverter plate gear 232 may be mounted on the same shaft of the diverter plate 233 to replace the diverter motor in the existing design. Accordingly, the single motor 228 may be used to rotate both the grinding plate 208*a* and the diverter plate 233 in both a high-speed setting or a low-speed setting when the second idler gear 231 is in the engaged position. In some embodiments, the first idler gear 230 may be a one way bearing that may rotate the grinding plate 208*a* in a first direction (e.g., clockwise direction), and the diverter plate 233 or the spray system in an opposite, second direction (e.g., a counterclockwise direction).

It should be understood that the radius/configurations of any one or more of those gears 227, 229, 230, 231, and 232 may be selected to form any desired degree of gear reduction or gear increase between the grinding motor gear 229 and the grinding shaft gear 227 and the diverter plate gear 232 to control the relative rotational speeds of the grinding plate 208*a* and the diverter plate 233 in addition to relative rotational directions. It should be also understood that different gear arrangements may also be adopted, including gear trains and/or belt drive systems that provide for varying of the relative rotational speeds. For example, a stacked arrangement of gears may be used for co-rotation of the grinding plate 208*a* and the diverter plate 233. Thus, one benefit of the disclosed design here is that the grinding plate 208*a* and the diverter plate 233 may be rotated at different speeds than the operation speed of the grinding motor 228 to accomplish the same relative speed difference. The same magnitude of shear force may be created at lower rotational speeds, which means that a smaller motor 228 may be used, leading to less noise and potential energy saving. It should be understood that the motor 228 for the components of the filtration assembly 200 (such as the grinding plate 208*a*, the diverter plate 233, and the self-cleaning device 300 as discussed below) may be any suitable driver such as a DC or AC electrical motor operated by a controller. The motor may rotate in a clockwise direction, a counterclockwise direction, or both directions.

Accordingly, during operation of the dishwashing appliance 100, with the recirculation pump 2 operating, the dishwashing fluid stored in the sump housing 206 of the filtration assembly 200 may be simultaneously or selectively directed to the upper spray arm assembly 109 and/or the lower spray arm assembly 110. The dishwashing fluid may be provided with a dishwashing agent dispensed from the detergent dispenser 112 to wash the washable items 1 received in the racks 104 and 105 within the dishwashing chamber 102. The dishwashing fluid circulates through the dishwashing chamber 102, flowing into the filtration assembly 200 through the first filter 202 into the sump housing 206 for further flirtation by one or more filters (e.g., the second and third filters 204 and 205), then into the recirculation pump 2 via the recirculation pump inlet port 216 as best shown in FIG. 5, then through the recirculation pump outlet port 219 back to the spray system.

During the operation of the grinding assembly 208, the large dishwashing debris conveyed by the soil trap 203*a* to the grinding mechanism 208 may be forced by the swivel lugs 208*b* and/or the breaker member 208*d* against the notches of the grinding ring 208*c*, and the edges of the notches may grind the dishwashing debris into particulate matter. Due to gravity, the pulverized particulate matter that is sufficiently small to pass through the gaps and/or notches of the grinding ring 208*c* drops into the debris collection chamber 210, along with dishwashing fluid, then is discharged through a discharge outlet port 218. In some embodiments, size control may be achieved through controlling the size of the gaps and/or notches through which the pulverized particles must pass. It should be understood that the fineness of the ground waste is also affected by the rotational speed and the trajectory of the dishwashing debris into the grinding mechanism. Thus, with such a configuration of the grinding type filtration assembly 200, most of the large dishwashing debris in the dishwashing fluid may be removed/shredded/pulverized before passing through the one or more filter screens. This may greatly alleviate the potential filter clogging problems, thereby improving dishwashing efficiency and performance.

The filtration assembly 200 discussed above (e.g., including the first filter 202, the second filter 204, the sump housing 206, and the grinding assembly 208, etc.) may be made either of sheet-metal or a plastic material that are able to withstand the changing temperatures in the dishwashing chamber 102 without deforming. For example, the sump housing 206 may be molded from a plastic material, such as polypropylene, or a high strength plastic material, such as nylon. The sump housing 206 may illustratively be molded as separate pieces and joined together, or as a single piece. In some embodiments, the grinding assembly 208 (e.g., including the grinding plate 208*a*, the lug 208*b*, the grinding ring 208*c*, and the breaker member 208*d*, etc.) may be formed from metal and made by a stamping process, providing sharp corners, angles and levels for cutting the dishwashing debris. In some embodiments, the grinding plate 208*a* may define a radius larger than the grinding ring 208*c*. It should be understood that the specific design of the filtration assembly 200 may vary depending on the size and use of the dishwashing appliance 100. For example, the size of the filters 202, 204, and 205 may be adapted to ensure the desired filtering capacity for the specific dishwashing appliance 100 it is intended to be fitted in. It should also be appreciated, however, that in some other embodiments, the filtration assembly 200 may have any other suitable configurations different from the description herein. For example, the recirculation intake port 208 and/or the recirculation pump inlet port 216 may be positioned at any other suitable locations within the filtration assembly 200.

As discussed previously, the filter screens 202, 204, and 205 may get clogged, particularly in the pre-wash cycle when a large amount of loose dishwashing debris is falling into the debris collection chamber 210 and accumulate therein. More dishwashing debris could also come down from the washable item 1 when the dishwashing cycle starts. As fluid passes through the filter screens 202, 204, and 205, the dishwashing debris may be blocked by the openings thereof and accumulate on the exterior surface of the filter screens 202, 204, and 205 and deleteriously affect the filtration efficiency by blocking the openings. For example, with a large amount of the dishwashing debris accumulated in the debris collection chamber 210, and if the accumulation cannot be removed quickly, the filter's clean surface of the filter screen areas may reduce and eventually reach a critical value at which the dishwashing fluid through flow rate becomes lower than that required by the recirculation pump 2. For conventional filtration assemblies with a fine filter screen prior to the dishwashing fluid entering the circulation pump, the circulation pump may run out of dishwashing fluid due to the clogging and stop operating completely. As a result, the dishwashing operation may have to be terminated prematurely due to the potential pump failure, resulting in reduced dishwashing efficiency, increasing the water and energy usage and the running cost.

Figure 7C:
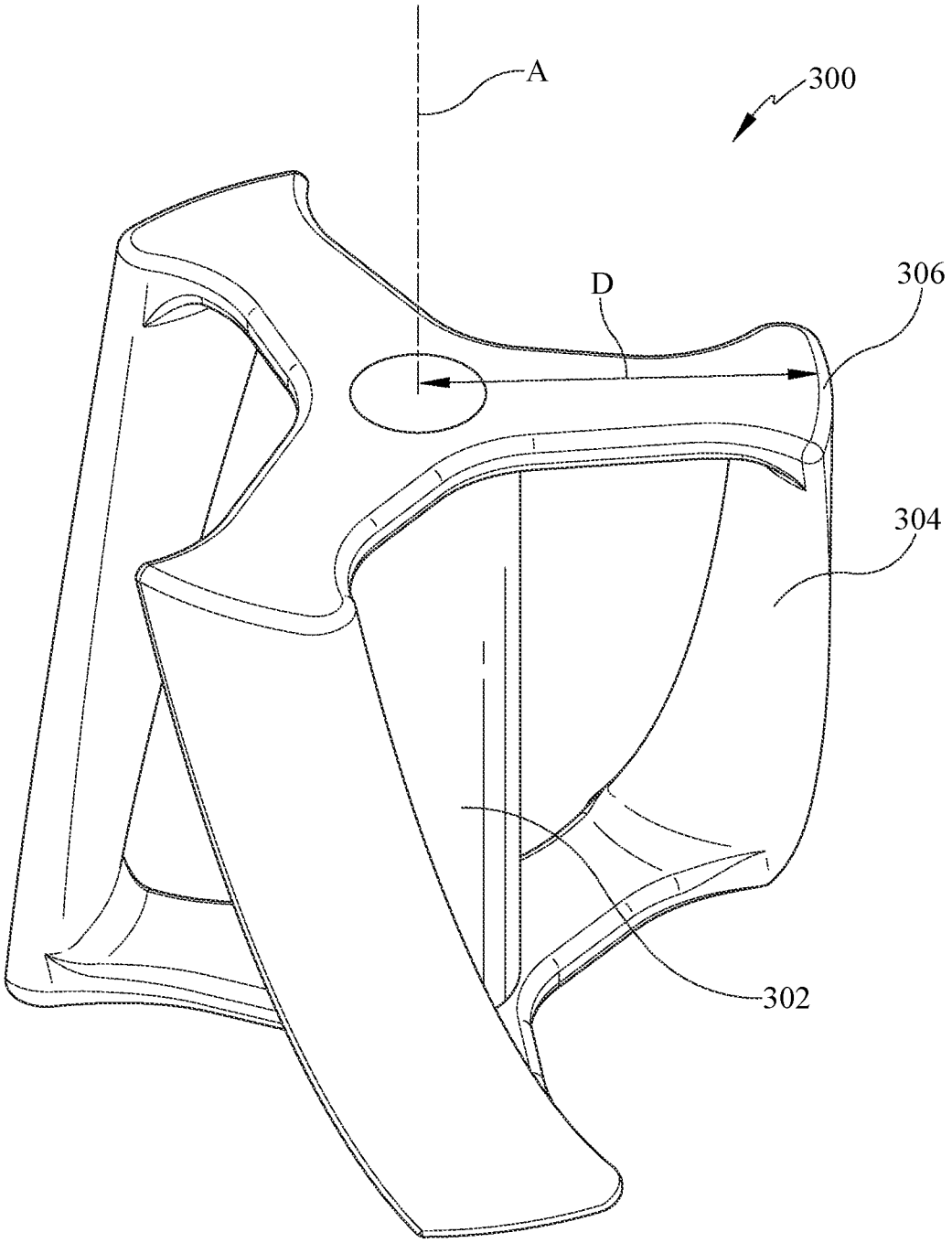
FIG. 7C is a perspective view of the built-in rotating self-cleaning device of FIG. 7A, according to an embodiment of the present disclosure.

As set forth above, clogging of filter components is an important issue in dishwashing appliance design. Accordingly, in some embodiments, as shown in FIGS. 7A-7C, a self-cleaning device 300 designed to automatically remove sediment build-up and clogging of the filter screens during wash and drain cycles is provided. The filter self-cleaning device 300 may be configured to rotate about the vertical axis A to remove the collected dishwashing debris from the filter screen surfaces (e.g., the second filter 204). In some embodiments, the self-cleaning device 300 may also be mounted within the grinding volume portion 223 (e.g., within the volume of the second filter 204) to drive large dishwashing debris into the grinding assembly 208. In particular, in some embodiments, the self-cleaning device 300 may include a post 302 (e.g., the shaft 226), with one end thereof mounted to the grinding plate 208*a* and extends away therefrom, e.g., along the first, axial direction A. A plurality of blades 304, e.g., two, three, four, five, or more blades, may be mounted to post 302 and extend away therefrom, e.g., along the second, radial direction R. In such embodiments, each of the plurality of blades 304 may extend away from the post 302 towards the filter (e.g., the second filter 204) to be cleaned. Further, each of the plurality of blades 304 may include a distal portion 306 that is positioned farthest away from the post 302 and spaced apart therefrom by about a first distance D. As the second filter 204 may be spaced apart from the post 302 by about a second, radial distance R1, the first and second distances D and R1 may be different in various embodiments. In particular, in some embodiments, the first distance D from the distal portion 306 to the post 302 may be less than the second distance R1, such that the distal portion 306 of plurality of blades 304 may not impact or touch the inner surface of the second filter 204. By contrast, in some embodiments, the rotatable self-cleaning device 300 may be equipped with features for scraping or wiping the surfaces of the second filter 204, thus preventing the one or more filter screens from clogging due to the dishwashing debris. In such embodiments, the first distance D from the distal portion 306 to the post 302 may be larger than or equal to the second distance R1. FIG. 7C illustrates an exemplary embodiments of the rotatable self-cleaning device 300 in an approximate impeller configuration. In such embodiments, three curved and hollow blades 304 are attached to the post 302. It should be understood that various configurations/shapes of the blades 304 of the rotatable self-cleaning device 300 may be used.

During rotation, the self-cleaning device 300 may stir, churn, and/or agitate the dishwashing fluid and dishwashing debris contained therein in order to hinder dishwashing debris collection on the surface of the second filter 204. In various exemplary embodiments, the self-cleaning device 300 may be configured for rotating in a first direction (e.g., clockwise), a second direction (e.g., counterclockwise), or both the first and second directions. Thus, the self-cleaning device 300 may rotate in any suitable direction or combination of directions for hindering clogging of the second filter 204. In some embodiments, energy from the fluid flow caused by a pump may be used to rotate the self-cleaning device 300, i.e., energy from fluid flow caused by the recirculation pump 2 may be used to rotate the self-cleaning device 300. In such embodiments, the self-cleaning device 300 may include an impeller or be in an impeller configuration for rotation in response to the driving force created by the pump (e.g., the recirculation pump 2) moving the dishwashing fluid flow. It should be understood that the operation of the self-cleaning device 300 built in the filtration assembly 200 may also be activated by an independent driving mechanism (e.g., the motor 228 for driving the rotating plate 208*a* or an independent motor, etc.). In such embodiments, the self-cleaning device 300 may precisely and effectively sweep away dishwashing debris from the filter screen surfaces, yet operates independently of the distribution devices (e.g., rotating spraying arms) of the dishwashing appliance.

In general, it should be understood that some features described above do not constitute limitations of the present disclosure, but rather have only been described for the sake of completeness. Instead, the present disclosure is particularly directed to a dishwashing appliance 100 configuration along with a grinding type filtration assembly 200. It should also be understood that the filtration assembly 200 may be a variety of constructions, shapes, sizes, quantities, and positions but still accomplish the same intent. The filtration assembly 200 depicted in the accompanying figures may include additional components and that some of the components described in those figures may be removed and/or modified without departing from scopes of the elements disclosed herein. The elements depicted in the figures may not be drawn to scale and thus, the elements may have different sizes and/or configurations other than as shown in the figures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A dishwashing appliance comprising:

a first filter with a first filtering permeability in a flat lid configuration, configured to receive the dishwashing fluid;

a second filter with a second filtering permeability coupled to said first filter;

a sump housing through which said second filter is disposed therein, said second filter separates said sump housing into a grinding volume portion and a recirculation volume portion;

a rotatable grinding plate and a stationary grinding ring at a bottom of said grinding volume portion of said sump housing, wherein said rotatable grinding plate is coupled to a shaft driven by a grinding motor and said stationary grinding ring includes a plurality of notches; and wherein said rotatable grinding plate further includes a plurality of swivel lugs extending upwards thereon.

2. The dishwashing appliance of claim 1, wherein said stationary grinding ring further includes a plurality of breaker members extending towards the center thereof.

3. The dishwashing appliance of claim 1, wherein said grinding motor driving the said rotatable grinding plate is independent from one or more motors driving a recirculation pump and/or a drainage pump.

4. The dishwashing appliance of claim 1, wherein said grinding motor is coupled to one or more gears to rotate a diverter plate when said one or more gears are engaged.

5. The dishwashing appliance of claim 4, wherein said grinding plate is rotated by said grinding motor in a first direction and/or speed while said diverter plate is rotated by said grinding motor in a second direction and/or speed.

6. The dishwashing appliance of claim 4, wherein at least one of said one or more gears is a one way bearing.

7. The dishwashing appliance of claim 4, wherein said diverter plate is selectively engageable by moving at least one of said one or more gears via a solenoid or wax motor.

8. The dishwashing appliance of claim 1, wherein said first filtering permeability is greater than said second filtering permeability.

9. The dishwashing appliance of claim 1, wherein said first filtering permeability is smaller than said second filtering permeability.

10. The dishwashing appliance of claim 1, further including a third filter in an approximate cylinder/cone-shaped configuration with a third filtering permeability surrounding said second filter.

11. The dishwashing appliance of claim 1, further comprising a rotatable self-cleaning device engaging at least a portion of said second filter.

12. The dishwashing appliance of claim 11, wherein said rotatable self-cleaning device is positioned within said grinding volume portion, wherein said rotatable self-cleaning device comprises: a plurality of blades arranged axially within the grind volume portion.

13. A filtration assembly for an appliance including a tub defining a washing chamber having a tub bottom, said filtration assembly positioned at bottom of said washing chamber through an opening formed by said tub bottom thereof, said filtration assembly comprising:

a first filter with a first filtering permeability in a flat lid configuration, configured to receive all said dishwashing fluid and positioned at top of said filtration assembly and above said opening of said tub bottom to allow said dishwashing fluid to flow into said filtration assembly;

a second filter with a second filtering permeability coupled to said first filter;

a sump housing through which said second filter is disposed therein, said second filter adjacent an inner surface of said sump housing to separate said sump housing into a grinding volume portion and a recirculation volume portion;

a grinding assembly at a bottom of said grinding volume portion of said sump housing, including a rotatable grinding plate coupled to a shaft driven by a grinding motor and a stationary grinding ring having a plurality of notches; and a rotatable self-cleaning device positioned in said sump housing, wherein said rotatable self-cleaning device physically contacts at least a portion of said second filter to remove dishwashing debris thereon.

14. The filtration assembly of claim 13, wherein said rotatable self-cleaning device is positioned within said grinding volume portion, wherein said rotatable self-cleaning device comprises: a plurality of blades arranged axially within the grind volume portion.

15. The filtration assembly of claim 14, wherein said plurality of blades are coupled to said shaft of said grinding assembly extending along a first direction, and said rotatable self-cleaning device is positioned within the volume of said second filter with said plurality of blades extending away therefrom along a second direction perpendicular to said first direction.

16. The filtration assembly of claim 15, wherein each of said plurality of blades physically contacts at least said portion of said second filter to remove dishwashing debris thereon into said grinding volume portion.

17. The filtration assembly of claim 15, wherein each of said plurality of blades has a distal portion that is positioned away from said shaft by about a first distance along said second direction, wherein said second filter is positioned away from said shaft by about a second distance along said second direction, wherein said second distance is greater than said first distance.

18. The filtration assembly of claim 13, wherein said rotatable self-cleaning device is rotated by said grinding motor.

19. The filtration assembly of claim 13, wherein said rotatable self-cleaning device is rotated by a motor independent from said grinding motor.

20. The filtration assembly of claim 13, wherein said rotatable self-cleaning device is rotated by a rotational force by virtue of said dishwashing fluid flowing therethrough.

21. A dishwashing appliance comprising:

a first filter with a first filtering permeability in a flat lid configuration, configured to receive the dishwashing fluid;

a second filter with a second filtering permeability coupled to said first filter;

a sump housing through which said second filter is disposed therein, said second filter separates said sump housing into a grinding volume portion and a recirculation volume portion;

a rotatable grinding plate and a stationary grinding ring at a bottom of said grinding volume portion of said sump housing, wherein said rotatable grinding plate is coupled to a shaft driven by a grinding motor and said stationary grinding ring includes a plurality of notches; and wherein said grinding motor is coupled to one or more gears to rotate a diverter plate when said one or more gears are engaged.

22. The dishwashing appliance of claim 21, wherein said grinding plate is rotated by said grinding motor in a first direction and/or speed while said diverter plate is rotated by said grinding motor in a second direction and/or speed.

23. The dishwashing appliance of claim 21, wherein at least one of said one or more gears is a one way bearing.

24. The dishwashing appliance of claim 21, wherein said diverter plate is selectively engageable by moving at least one of said one or more gears via a solenoid or wax motor.

25. The dishwashing appliance of claim 21, wherein said first filtering permeability is greater than said second filtering permeability.

26. The dishwashing appliance of claim 21, wherein said first filtering permeability is smaller than said second filtering permeability.

27. The dishwashing appliance of claim 21, further including a third filter in an approximate cylinder/cone-shaped configuration with a third filtering permeability surrounding said second filter.

28. The dishwashing appliance of claim 21, further comprising a rotatable self-cleaning device engaging at least a portion of said second filter.

29. The dishwashing appliance of claim 28, wherein said rotatable self-cleaning device is positioned within said grinding volume portion, wherein said rotatable self-cleaning device comprises: a plurality of blades arranged axially within the grind volume portion.

30. The dishwashing appliance of claim 21, wherein said grinding motor driving the said rotatable grinding plate is independent from one or more motors driving a recirculation pump and/or a drainage pump.

31. The dishwashing appliance of claim 21, wherein said rotatable grinding plate further includes a plurality of swivel lugs extending upwards thereon, and wherein said stationary grinding ring further includes a plurality of breaker members extending towards the center thereof.

32. A dishwashing appliance comprising:

a first filter with a first filtering permeability in a flat lid configuration, configured to receive the dishwashing fluid;

a second filter with a second filtering permeability coupled to said first filter;

a sump housing through which said second filter is disposed therein, said second filter separates said sump housing into a grinding volume portion and a recirculation volume portion;

a rotatable grinding plate and a stationary grinding ring at a bottom of said grinding volume portion of said sump housing, wherein said rotatable grinding plate is coupled to a shaft driven by a grinding motor and said stationary grinding ring includes a plurality of notches; and a rotatable self-cleaning device engaging at least a portion of said second filter, wherein said rotatable self-cleaning device is positioned within said grinding volume portion, wherein said rotatable self-cleaning device comprises: a plurality of blades arranged axially within the grind volume portion.

33. The dishwashing appliance of claim 32, wherein said grinding motor driving the said rotatable grinding plate is independent from one or more motors driving a recirculation pump and/or a drainage pump.

34. The dishwashing appliance of claim 32, wherein said first filtering permeability is greater than said second filtering permeability.

35. The dishwashing appliance of claim 32, wherein said first filtering permeability is smaller than said second filtering permeability.

36. The dishwashing appliance of claim 32, further including a third filter in an approximate cylinder/cone-shaped configuration with a third filtering permeability surrounding said second filter.

37. The dishwashing appliance of claim 32, wherein said grinding motor is coupled to one or more gears to rotate a diverter plate when said one or more gears are engaged, and wherein said grinding plate is rotated by said grinding motor in a first direction and/or speed while said diverter plate is rotated by said grinding motor in a second direction and/or speed.

38. The dishwashing appliance of claim 32, wherein said grinding motor is coupled to one or more gears to rotate a diverter plate when said one or more gears are engaged, and wherein at least one of said one or more gears is a one way bearing.

39. The dishwashing appliance of claim 32, wherein said grinding motor is coupled to one or more gears to rotate a diverter plate when said one or more gears are engaged, and wherein said diverter plate is selectively engageable by moving at least one of said one or more gears via a solenoid or wax motor.

40. The dishwashing appliance of claim 32, wherein said rotatable grinding plate further includes a plurality of swivel lugs extending upwards thereon, and wherein said stationary grinding ring further includes a plurality of breaker members extending towards the center thereof.

* * * * *